US009730515B2

(12) United States Patent
Bachor et al.

(10) Patent No.: US 9,730,515 B2
(45) **Date of Patent: *Aug. 15, 2017**

(54) PULLOUT GUIDE

(71) Applicant: PAUL HETTICH GMBH & CO. KG, Kirchlengern (DE)

(72) Inventors: Juergen Bachor, Kirchlengern (DE); Peter Jaehrling, Buende (DE); Daniel Rehage, Bielefeld (DE); Daniel Reidt, Herford (DE); Sebastian Bastkowski, Herford (DE); Edgar Frobieter, Hasbergen (DE); Matthias Kunsch, Hamburg (DE); Christian Koldewey, Bielefeld (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 15 days.

This patent is subject to a terminal disclaimer.

(21) Appl. No.: 14/433,936

(22) PCT Filed: Oct. 1, 2013

(86) PCT No.: PCT/EP2013/070453

§ 371 (c)(1),
(2) Date: Apr. 7, 2015

(87) PCT Pub. No.: WO2014/056763

PCT Pub. Date: Apr. 17, 2014

(65) Prior Publication Data

US 2015/0289648 A1 Oct. 15, 2015

(30) Foreign Application Priority Data

Oct. 12, 2012 (DE) ..... 10 2012 109 760
Mar. 22, 2013 (DE) ..... 10 2013 102 944

(51) Int. Cl.

| | |
|---|---|
| ***A47B 88/04*** | (2006.01) |
| ***A47B 88/16*** | (2006.01) |
| ***A47B 88/931*** | (2017.01) |
| ***A47B 88/40*** | (2017.01) |
| ***A47B 88/467*** | (2017.01) |
| ***A47B 88/493*** | (2017.01) |
| ***A47B 88/57*** | (2017.01) |

(52) U.S. Cl.
CPC ..... *A47B 88/16* (2013.01); *A47B 88/40* (2017.01); *A47B 88/467* (2017.01); (Continued)

(58) Field of Classification Search
CPC ..... A47B 88/04; A47B 88/10; A47B 88/16; A47B 88/047; A47B 88/0085; (Continued)

(56) References Cited

U.S. PATENT DOCUMENTS

| | | |
|---|---|---|
| 4,988,214 A | 1/1991 | Clement |
| 5,730,514 A | 3/1998 | Hashemi |

(Continued)

FOREIGN PATENT DOCUMENTS

| | | |
|---|---|---|
| CN | 1823653 | 8/2006 |
| DE | 27 21 231 | 11/1978 |

(Continued)

*Primary Examiner* — James O Hansen
(74) *Attorney, Agent, or Firm* — Michael J. Striker

(57) ABSTRACT

A pullout guide for domestic appliances or furniture has a first rail, a second rail and a third rail mounted to be movable in relation to one another. The third rail is fixed on a body and the first rail is connected to a thrust element. A locking mechanism is provided to lock the first rail against movement in relation to the second rail in a predetermined locking position. The locking mechanism has a locking element that is pre-tensioned in a springy manner in the predetermined locking position.

16 Claims, 17 Drawing Sheets

(52) U.S. Cl.
CPC ..... *A47B 88/493* (2017.01); *A47B 88/57* (2017.01); *A47B 88/931* (2017.01); *A47B 2210/0016* (2013.01); *A47B 2210/17* (2013.01)

(58) Field of Classification Search
CPC . A47B 2210/0018; A47B 88/40; A47B 88/57; A47B 88/467; A47B 88/493; A47B 88/931
USPC ..... 312/330.1, 334.1, 334.8, 334.11, 334.44, 312/334.45, 334, 46, 333, 334.46
See application file for complete search history.

(56) References Cited

U.S. PATENT DOCUMENTS

| | | | | |
|---|---|---|---|---|
| 5,757,109 | A | 5/1998 | Parvin | |
| 6,244,678 | B1 * | 6/2001 | Dopp | A47B 88/047 312/333 |
| 6,350,001 | B1 | 2/2002 | Chu | |
| 6,464,311 | B2 | 10/2002 | Liang et al. | |
| 6,655,763 | B2 * | 12/2003 | Judge | A47B 88/10 312/334.11 |
| 6,817,685 | B2 | 11/2004 | Lammens | |
| 7,111,913 | B2 | 9/2006 | Dubon | |
| 7,520,577 | B2 * | 4/2009 | Chen | A47B 88/10 312/333 |
| 7,654,624 | B2 | 2/2010 | Huang et al. | |
| 7,857,403 | B2 | 12/2010 | Chen et al. | |
| 8,240,789 | B2 | 8/2012 | Chen et al. | |
| 2006/0186773 | A1 | 8/2006 | Lam et al. | |
| 2007/0164644 | A1 | 7/2007 | Hwang et al. | |
| 2012/0020593 | A1 | 1/2012 | Rehage et al. | |

FOREIGN PATENT DOCUMENTS

| | | |
|---|---|---|
| DE | 87 14 720 | 12/1987 |
| DE | 37 88 217 | 3/1994 |
| DE | 20 2006 000 519 | 6/2006 |
| GB | 2 028 109 | 3/1980 |
| WO | WO 2010/060724 | 6/2010 |

* cited by examiner

Fig. 10
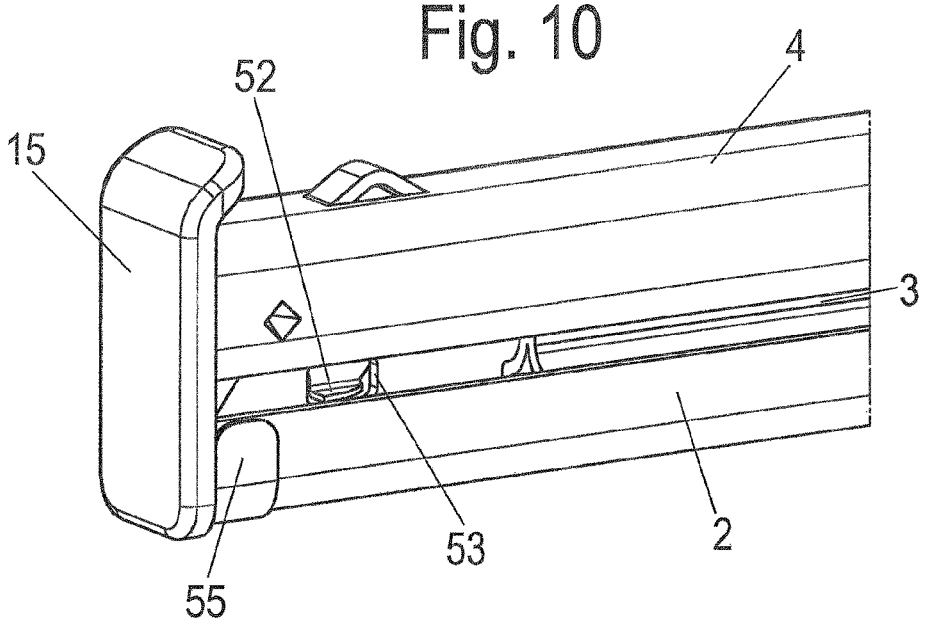
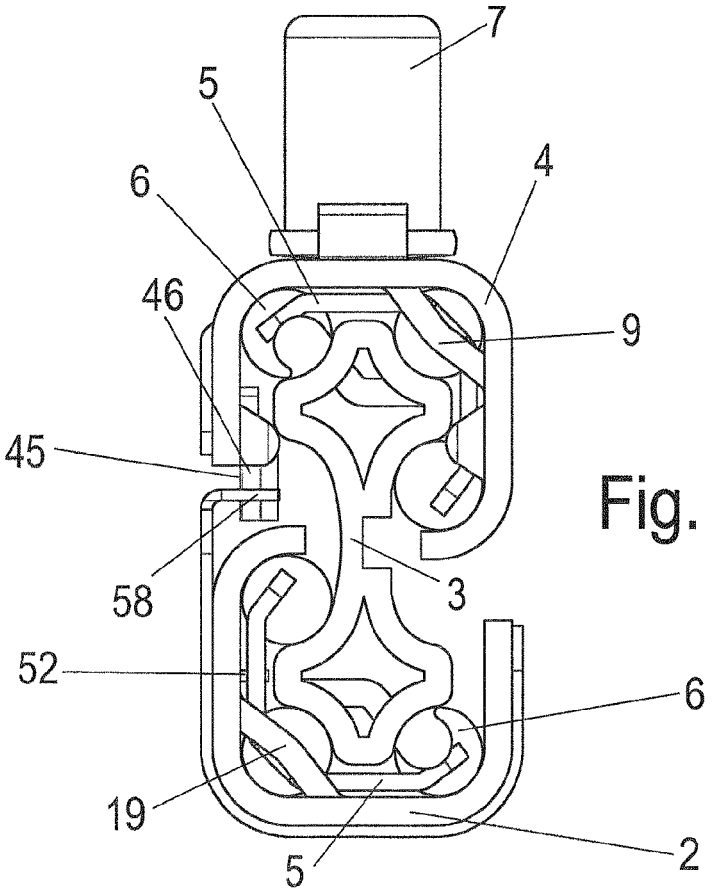
Fig. 11

PULLOUT GUIDE

CROSS-REFERENCE TO A RELATED APPLICATION

The invention described and claimed hereinbelow is a National Stage Application of PCT/EP2013/070453, filed Oct. 1, 2013 (the PCT application), under 35 USC §371. The PCT application claims priority from German Patent Application DE 10 2012 109 760.7 filed on Oct. 12, 2012 and German Patent Application 10 2013 102 944.2 filed on Mar. 22, 2013. The German priority application and the PCT application are incorporated herein by reference and provide the basis for a claim of priority of invention under 35 U.S.C. 119 (a)-(d).

BACKGROUND OF THE INVENTION

The present invention relates to a pullout guide, in particular for domestic appliances or furniture, having at least three rails mounted so they are movable in relation to one another, wherein one rail can be fixed on a body and one rail is connectable to a thrust element, wherein a locking mechanism is provided, to lock a first rail against a movement in relation to a second rail in a predetermined position.

WO 2010/060724 discloses a pullout guide, in which catch means are provided between the individual rails, which enable the movable slide rail to be latched in a pulled-out position. The catch elements comprise spring elements in this case, which can be fixed on corresponding catch recesses or projections. Latching the slide rail in one or more positions is possible using this arrangement, however, the catch forces can only be vaguely determined, because in particular in the case of a full pullout having at least three rails, two catch means are provided, wherein one of the two catch means must be disengaged to move the slide rail. Therefore, a sequence control for a pullout guide cannot be implemented using the catch means, in which it is determined when which rail is moved. In addition, the problem exists that during the retraction or extension of the slide rail, latching in an intermediate position must be canceled, which is perceived as annoying during a continuous movement.

SUMMARY OF THE INVENTION

It is therefore the object of the present invention to provide a pullout guide which has a defined sequence control and a high functional reliability.

According to the invention, the pullout guide comprises a locking mechanism having a locking element, which is pre-tensioned in a springy manner in the locking position. Due to the use of a locking element, it is firstly ensured that a rail of the pullout guide can be blocked against a movement, i.e., locking takes place, and not only latching, in which the latching can be disengaged by overcoming the catch forces. A defined sequence control can thus be provided using the locking mechanism, which has a high functional reliability even over longer use because of the pre-tension of the locking element.

According to one preferred embodiment of the invention, the locking element is fixed on one of the rails of the pullout guide, so that a more compact construction having only a few components results. The fixing can be performed in a friction-locked, form-fitting, or integrally-joined manner on the respective rail in this case.

An unlocking element is preferably provided, to unlock the locking mechanism and enable a movement of the first rail in relation to the second rail. Such an additional unlocking element prevents incorrect actuations in the pullout guide, wherein the unlocking element for the locking mechanism is preferably provided on the third rail. The unlocking element can then be moved together with the third rail, wherein a locking element is movable perpendicularly to the longitudinal direction of the rails via the unlocking element, for example. This enables a particularly reliable function of the pullout guide, wherein only little force must be applied for unlocking. The unlocking is thus hardly perceptible to the user.

For a simple mechanical embodiment of the locking mechanism, it can have a locking element, which engages directly on the first or second rail, for example, on a projection or a recess.

In a preferred embodiment, the locking mechanism has a locking element, which engages on a sliding element, on a roller body cage, or a roller body between the second and the third rail. This enables a particularly compact construction, wherein the locking element can engage through a recess or opening in one of the rails to reach the sliding element, the roller body cage, or the roller body. The roller bodies can have various geometries in this case, for example, spherical, in the form of a roller, or in the form of a drum.

The locking element can be implemented in this case as a bendable lever, which has an actuating section, on which an unlocking element can engage. Unlocking of the locking mechanism can thus be performed with little force.

For a reliable blockade, the locking element can be implemented as a projection on a bendable lever, which engages through a recess on a rail, for example, and implements a stop for a roller body cage, a roller body, or a wall section of a rail.

To enable latching of the pullout guide in a predetermined position, a catch mechanism is preferably provided. The catch mechanism can have a spring element in this case, which is bent before reaching the predetermined position of the first, second, or third rail, to then engage behind a catch means. The catch means can be implemented on one of the rails as a projection or recess, but a roller body or a projection or a recess on a roller body cage can also be used as the catch means.

The locking element of the locking mechanism and/or the spring element of the catch mechanism are preferably produced from a metal plate or wire, so that the pullout guide is also usable at higher temperatures. The pullout guide is preferably used for displacing a cooked material carrier in an oven. The pullout guide can also be used, of course, in other domestic appliances, furniture, or other units for displaceable mounting of objects. The pullout guide can be sterilized in an autoclave and is therefore also suitable for use in the medical field and in laboratories. Furthermore, the pullout guide is suitable for use in clean rooms.

BRIEF DESCRIPTION OF THE DRAWINGS

The invention will be explained in greater detail hereafter on the basis of several exemplary embodiments with reference to the appended drawings. In the figures:

FIG. 10 highlights the locking mechanism in an unlocked position;

FIG. 11 highlights a rear side view of the FIG. 1 pullout guide;

DETAILED DESCRIPTION OF THE INVENTION

Figure 1:
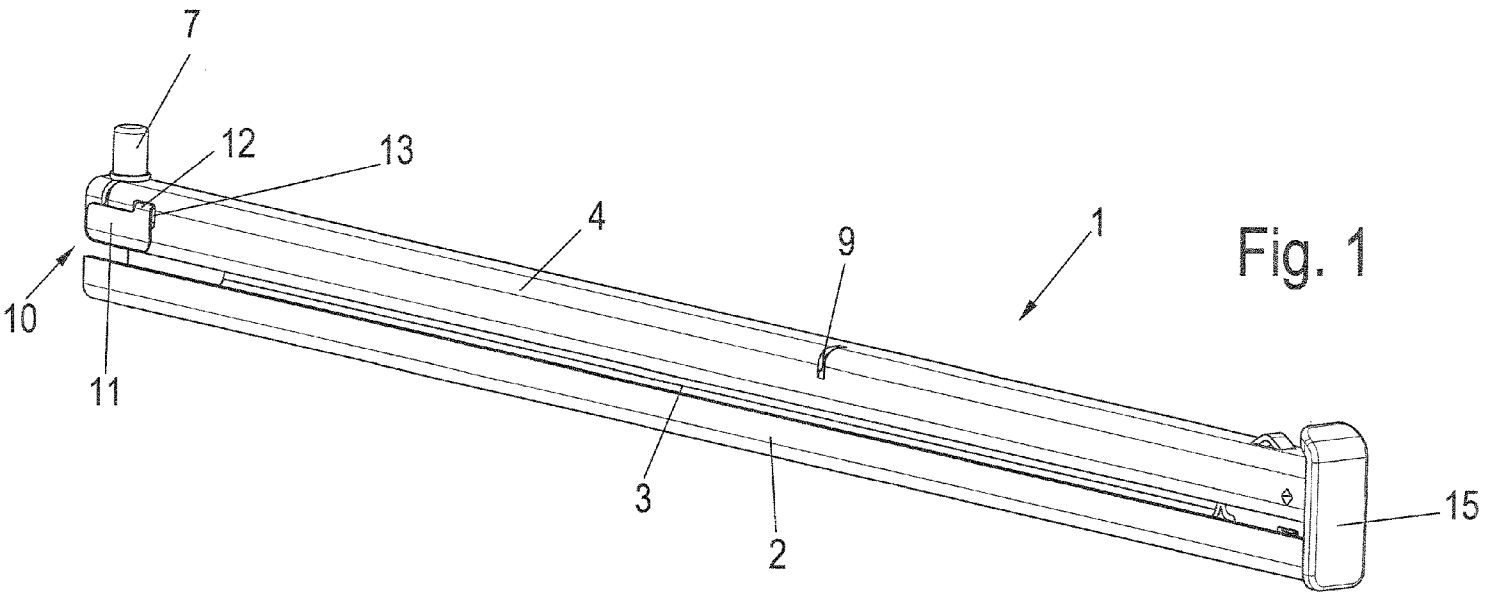
FIG. 1 shows a first exemplary embodiment of a pullout guide according to the invention.

A pullout guide 1 comprises a first rail 2, which can be fixed on a body of a piece of furniture or a domestic appliance, and which is usually arranged in a stationary manner, a second rail 3, which is implemented as a middle rail, and a third rail 4, which is also referred to as a slide rail, on which thrust elements, such as drawers, cooked material carriers, or other components can be mounted so they are movable. A plug 7, which protrudes upward on the third rail 4, is used for mounting a thrust element, for example, a cooked material carrier, while a plate 15 is fixed on the first rail 4 on the opposing front side.

As shown in FIG. 1, a catch mechanism 10 having a bendable spring element 11, which engages with a projection 12 through an opening 13 in the first rail 4, is located on the third rail 4. The projection 12 protrudes inward from the rail 4 and presses therein behind a spherical roller body 6 on a roller body cage 5. During the movement of the third rail 4, the roller body cage 5 with the roller bodies 6 is moved along the second rail 3 and the third rail 4 until the rearmost roller body 6 deflects the bendable spring element 11 outward and the projection 12 then latches behind the first roller body 6. To disengage the catch mechanism 10 from the catch position, the first rail 4 must now be moved back in the closing direction, whereby the projection 12 is deflected outward by the rearmost roller body 6, against the force of the spring element 11. Due to the comparatively exact guiding of the roller body 6 between the third rail 4 and the second rail 3, the deflection of the spring element 11 during the latching or unlatching is exactly defined, so that the catch forces can be set accordingly. Of course, it is also possible, instead of latching the spring element 11 on a roller body 6, to also perform latching on a projection or a recess on the roller body cage 5.

Figure 2:
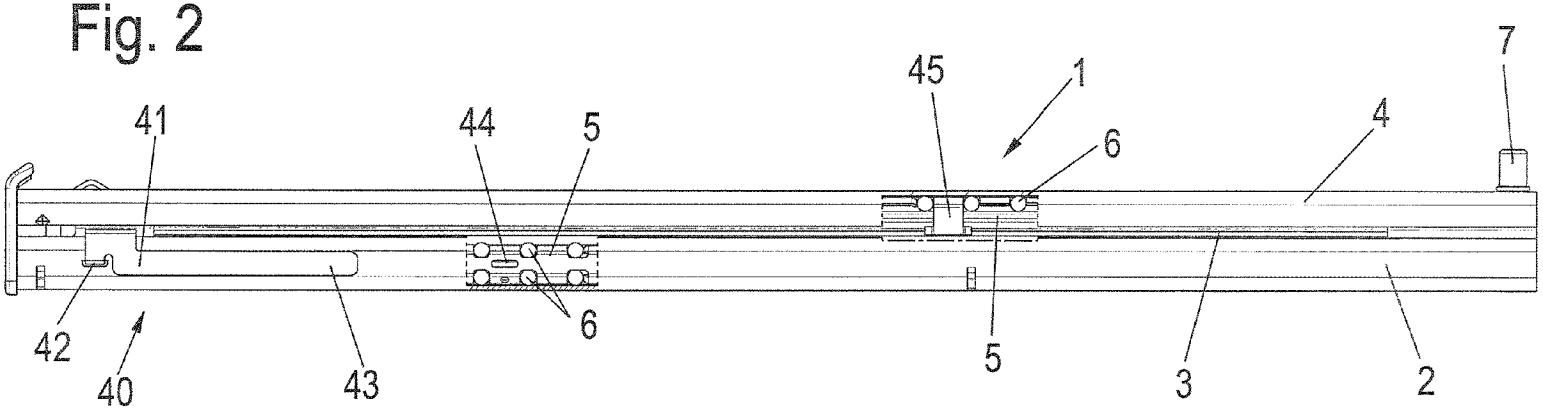
FIG. 2 highlights a locking mechanism of the FIG. 1 pullout guide.

Furthermore, a locking mechanism 40 is provided (FIG. 2), which acts between the first rail 2 and the second rail 3. Of course, it is possible to arrange the catch mechanism 10 on the first rail 2 or the second rail 3 and to provide the locking mechanism 40 on the third rail 4. Only the exemplary embodiments shown are explained hereafter, wherein it is also possible to change the position and the arrangement of the respective catch mechanism and/or locking mechanism, depending on which structural specifications exist for the respective pullout guide.

The locking mechanism 40 comprises a bendable spring web 41, which engages with a projection 42 through the first rail 2. On the side facing away from the projection 42, a fastening section 43 is provided, on which the spring web 41 is fixed on an outer side of the third rail 2, for example, by welding or gluing. A roller body cage 5 having a plurality of roller bodies 6 is provided between the first rail 2 and the second rail 3, wherein a recess 44 of the locking mechanism is arranged in the roller body cage 5.

A roller body cage 5 having a plurality of roller bodies 6 is also located between the second rail 3 and the third rail 4, wherein an actuating section 45 for unlocking the locking mechanism 40 is implemented integrally with the roller body cage 5.

Figure 3:
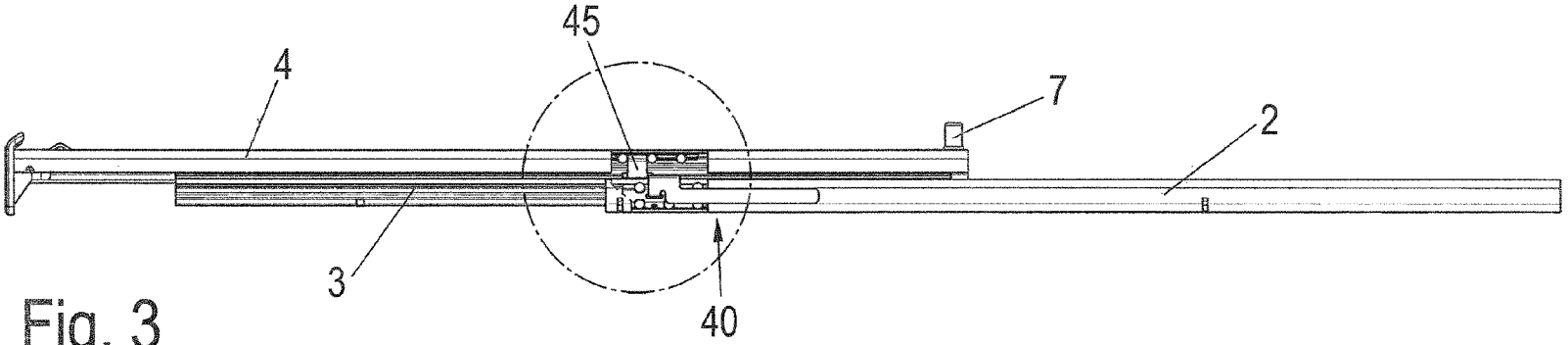
FIG. 3 highlights the FIG. 1 pullout guide in a pulled-out locked position.
Figure 4:
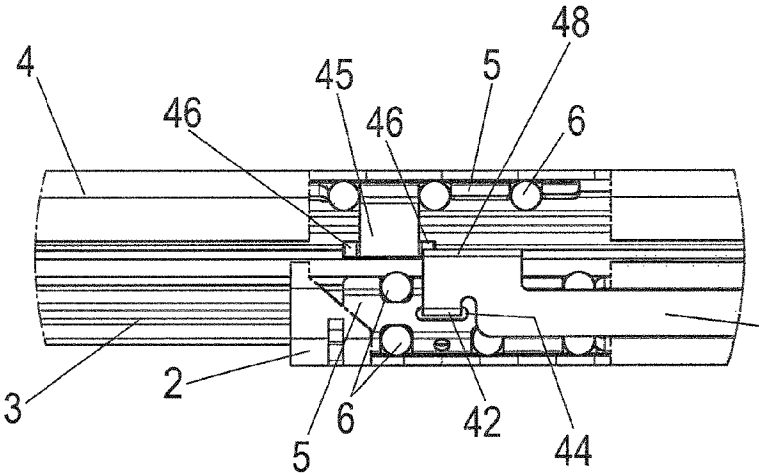
FIG. 4 highlights the unlocking mechanism with the FIG. 1 pullout guide in the pulled-out position.
Figure 5:
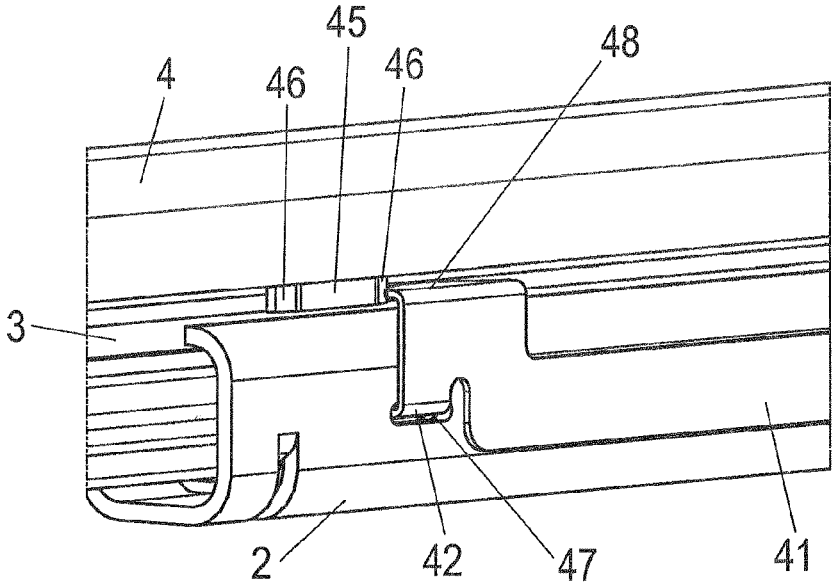
FIG. 5 highlights an actuating section of the unlocking element.

FIGS. 3 and 4 show the locking mechanism 40 in a locked position, while the catch mechanism 10 has already been disengaged and the third rail 4 has been moved in the closing direction. The unlocking element 45 on the roller body cage 5 is now located adjacent to the spring web 41, wherein intake bevels 46 are implemented on the unlocking element 45, which are used to move the spring web 41 outward, to move the projection 42 out of the recess 44 on the roller body cage 5. The unlocking element 45 acts in this case on an actuating section 48, which is implemented integrally with the spring web 41. As can be seen in the enlarged view of FIG. 5, the actuating section 48 is located with an angled projection between the first rail 2 and the third rail 4 and can therefore be engaged with the intake bevels 46 of the unlocking element 45. During the passage over the unlocking element 45, the projection 42 is briefly moved out of the recess 44 in the roller body cage 5, so that then the second rail 3 can be moved in the closing direction in relation to the first rail 2.

Figure 6:
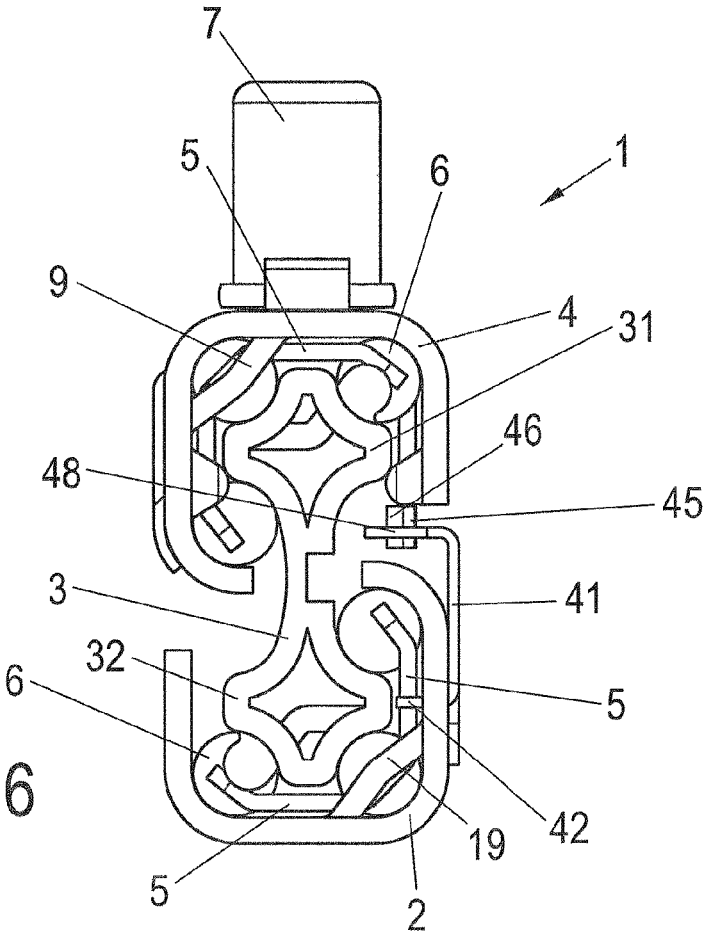
FIG. 6 highlights a rear side view of the FIG. 1 pullout guide.

FIG. 6 shows a rear side view of the pullout guide 1. The second rail 3 has two sections 31 and 32 which are cross-shaped in cross section, and on each of which three curved runways for spherical roller bodies 6 are implemented. The roller bodies 6 are held in this case on a roller body cage 5, the movement of which is limited by profiles 9 or 19 in the longitudinal direction of the rails 2, 3, and 4.

The inwardly directed actuating section 48 is pressed outward during the passage over the unlocking element 45, whereby simultaneously the projection 42 moves out of the recess in the roller body cage 5. The roller body cage 5 can simultaneously be moved freely or moved by a profile on the second rail 3 in the closing direction.

Figure 7:
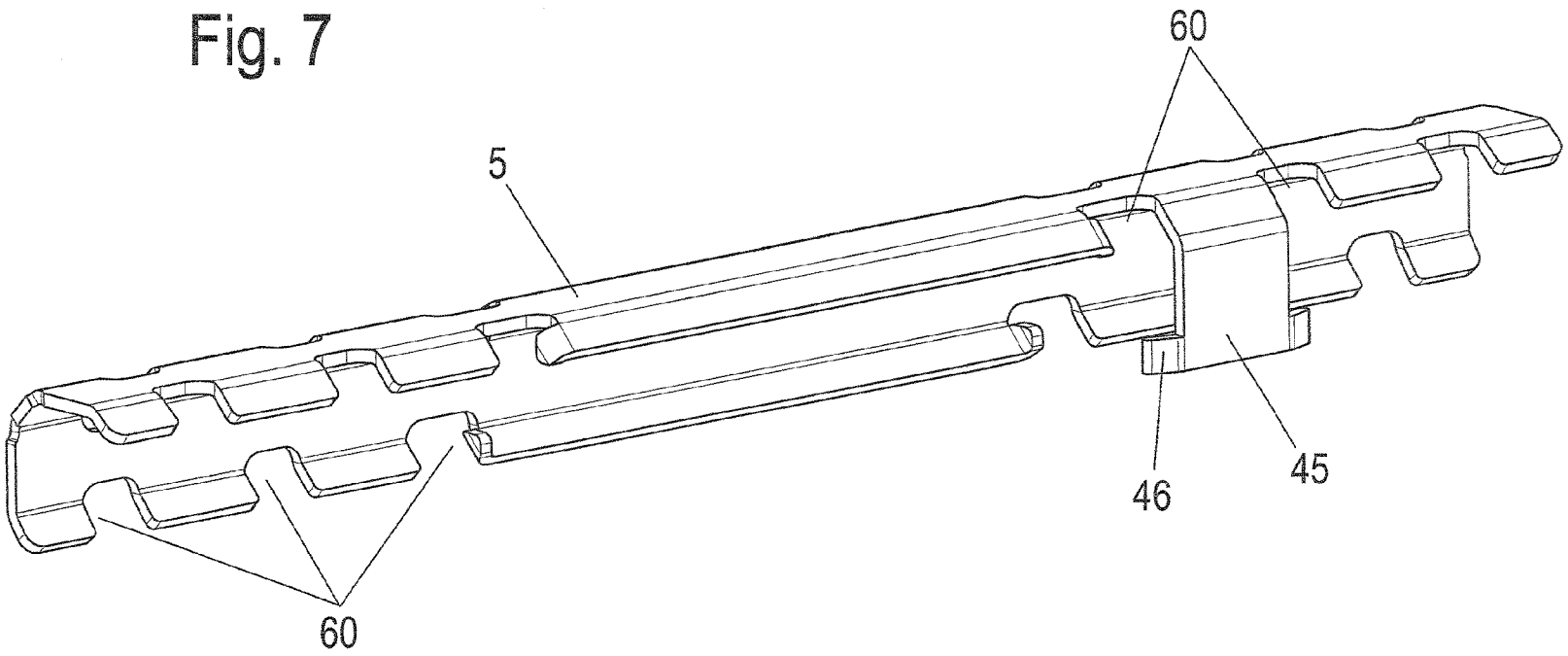
FIG. 7 highlights the roller body cage arranged between the second rail and the third rail of the FIG. 1 pullout guide.

FIG. 7 shows the roller body cage 5, which is arranged between the second rail 3 and the third rail 4. A plurality of pockets 60 for receiving a spherical roller body is implemented on the roller body cage 5. Furthermore, a downwardly protruding web-shaped unlocking element 45 is provided, on which the intake bevels 46 are formed.

In the following exemplary embodiments, the same reference signs are used for identical components, wherein essentially only the modified components will be explained hereafter in their function.

Figure 8:
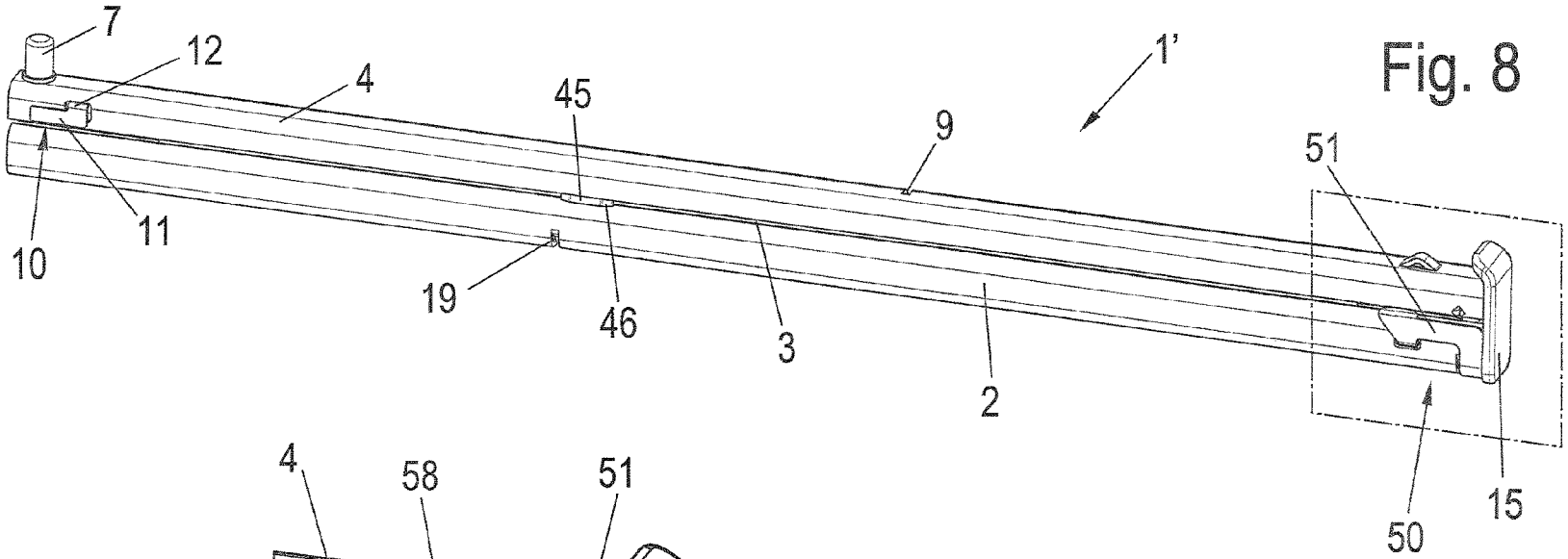
FIG. 8 shows a second exemplary embodiment of a pullout guide according to the invention.
Figure 9:
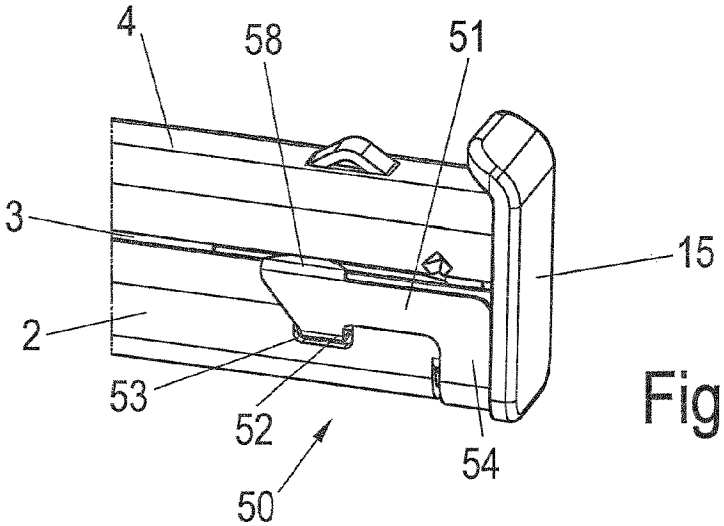
FIG. 9 highlights unlocking the locking mechanism of the FIG. 1 pullout guide.

FIG. 8 shows a further exemplary embodiment of a pullout guide 1', in which the catch mechanism 10 is implemented as in the first exemplary embodiment. Furthermore, a roller body cage 5, which has an unlocking element 45 having intake bevels 46, as is also shown in FIG. 9, is arranged between the second rail 3 and the third rail 4.

The pullout guide 1' comprises a modified locking mechanism 50, which is attached on the outside on the first rail 2. The locking mechanism 50 comprises a bendable spring element 51, which has a projection 52 on one side, which engages through an opening 53 in the first rail 2 and has a clamp-type section 54 on the rear end, which is arranged adjacent to a plate 15 of the pullout guide 1', wherein another arrangement is also conceivable. The clamp-type section 54 encloses the first rail 2 in a U-shape and can be fixed on the first rail 2 by welding or gluing. An actuating section 58, which is movable via the unlocking element 45, is implemented on the spring element 51 above the projection 52. FIG. 10 shows the recess 53 in the first rail 2, through which the projection 52 engages. Furthermore, one end 55 of the clamp-type section 54 is shown, which encloses the rail 2 in a U-shape. It is also conceivable that instead of the clamp-type section 54, an angled L-shaped or region designed in another way presses against or encloses the rail.

As can be seen in FIG. 11, the unlocking element 45 having the intake bevels 46 is located in a region of the actuating section 58, so that during passage over the unlocking element 45, the actuating section 58 is pressed outward, whereby the projection 52 also moves out of a recess in the roller body cage 5 between the first rail 2 and the second rail 3. The locking mechanism 50 can thus be unlocked, so that then the first rail can be moved in relation to the third rail 3.

Figure 12:
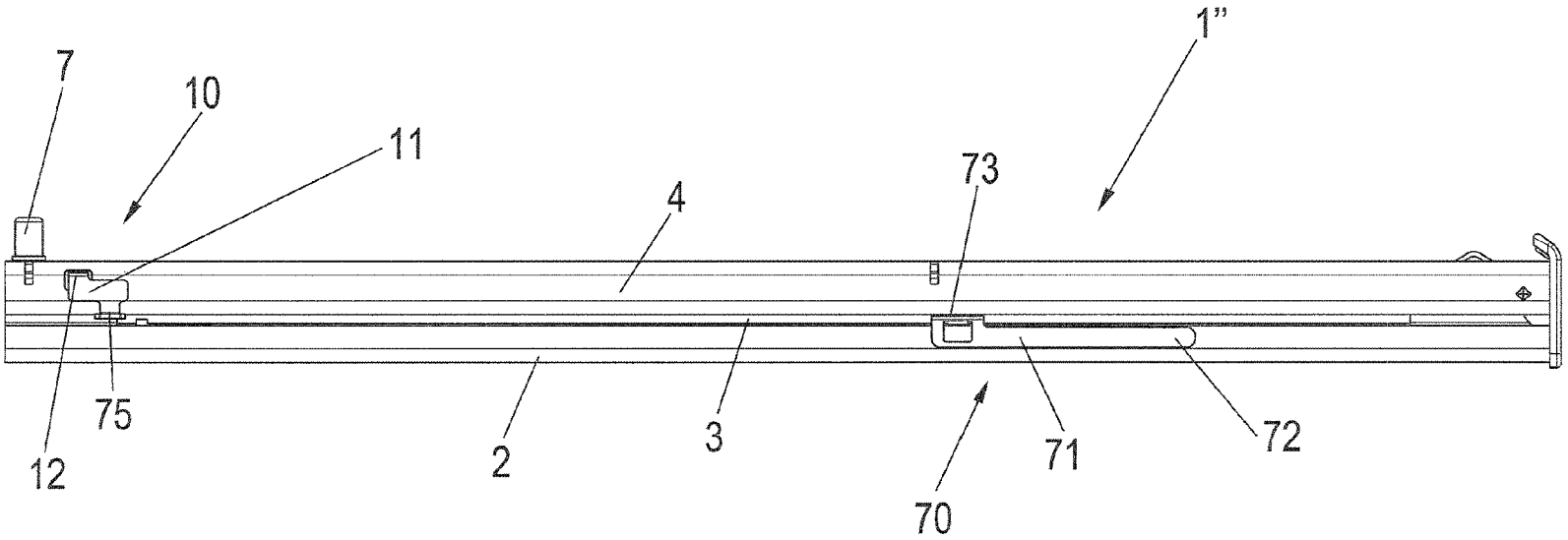
FIG. 12 shows a third exemplary embodiment of a pullout guide according to the invention.

FIG. 12 shows a third exemplary embodiment of a pullout guide 1", in which the rails 2, 3, and 4 are shown in a retracted position. The pullout guide 1" comprises a catch mechanism 10, which is implemented as in the preceding exemplary embodiments, but additionally has an unlocking element 75, which protrudes downward from the spring web 11. Furthermore, a modified locking mechanism 70 is provided, which has an oblong spring web 71, which is fixed with an end section 72 on the third rail 2. The spring web 71 is aligned in parallel to the longitudinal direction of the first rail 2 and can be bent outward in the region of a projection 74. Instead of an oblong spring web 71, a clamp-type locking mechanism is also conceivable here, which encloses the rail 2 transversely to the longitudinal direction.

Figure 13:
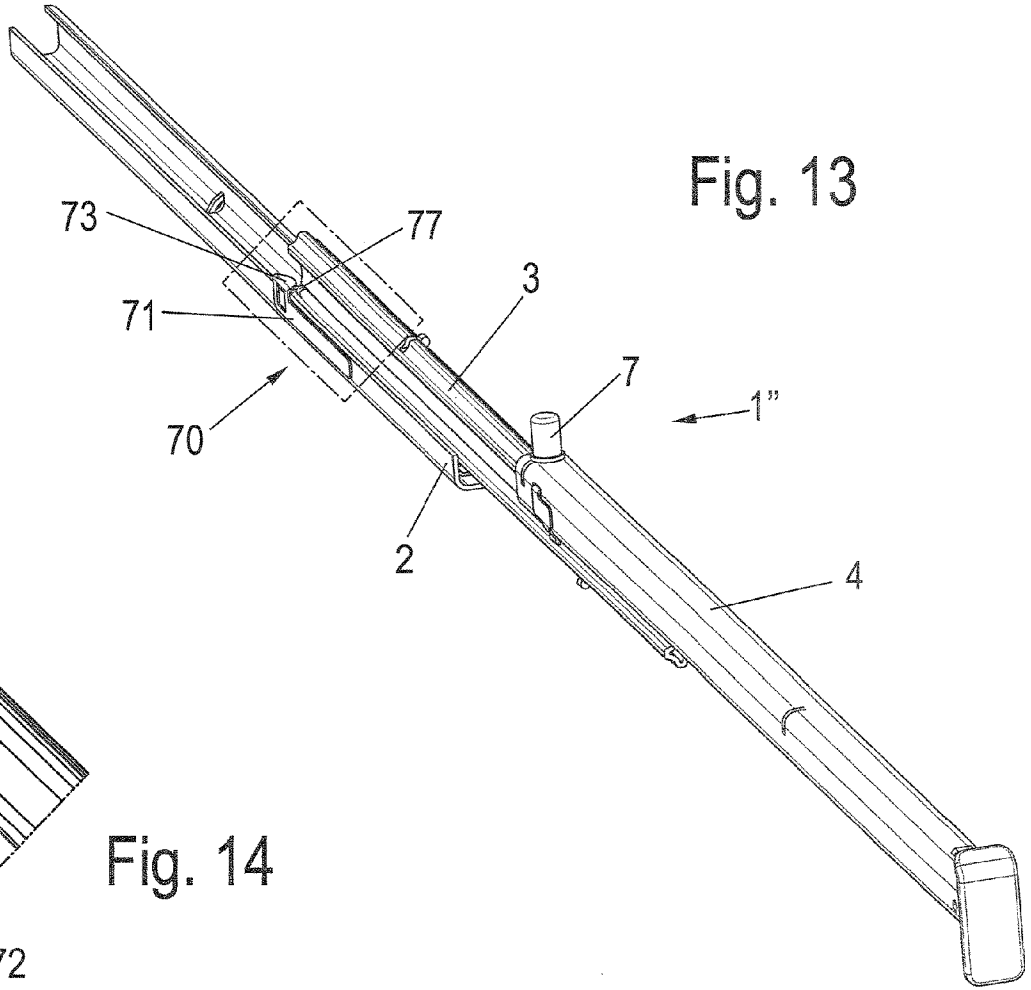
FIG. 13 shows the locking mechanism of the FIG. 12 pull-out guide where pull-out guide is in a pulled-out position.
Figure 14:
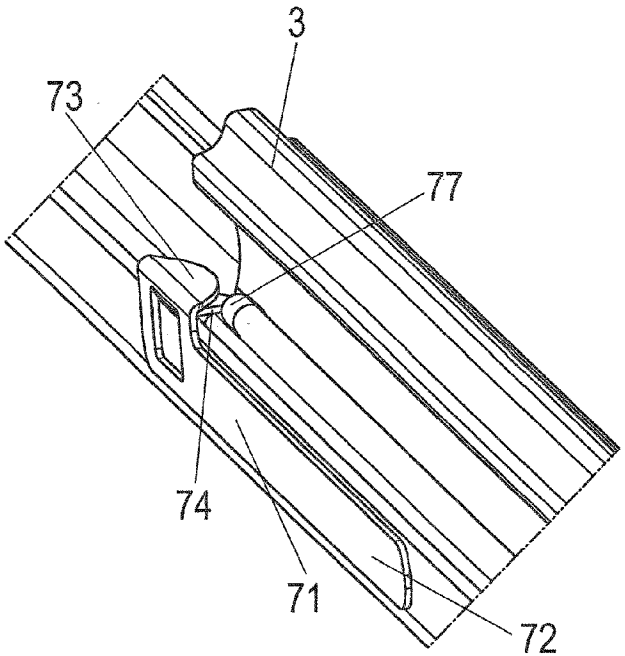
FIG. 14 highlights the locking mechanism of FIG. 12 pull-out guide.

FIGS. 13 and 14 show the locking mechanism in detail, wherein the pullout guide 1" is located in a pulled-out position, in which the locking mechanism 70 is active. The locking mechanism 70 comprises an actuating section 73, which is arranged adjacent to a projection 74. The actuating section 73 and the projection 74 are produced by stamping and bending and are located at different heights. The projection 74 forms the actual locking element, which presses against an embossed area 77 of the second rail 3, as can be seen in FIG. 14. This prevents the second rail 3 from moving in the closing direction when the locking mechanism 70 is active.

Figure 15:
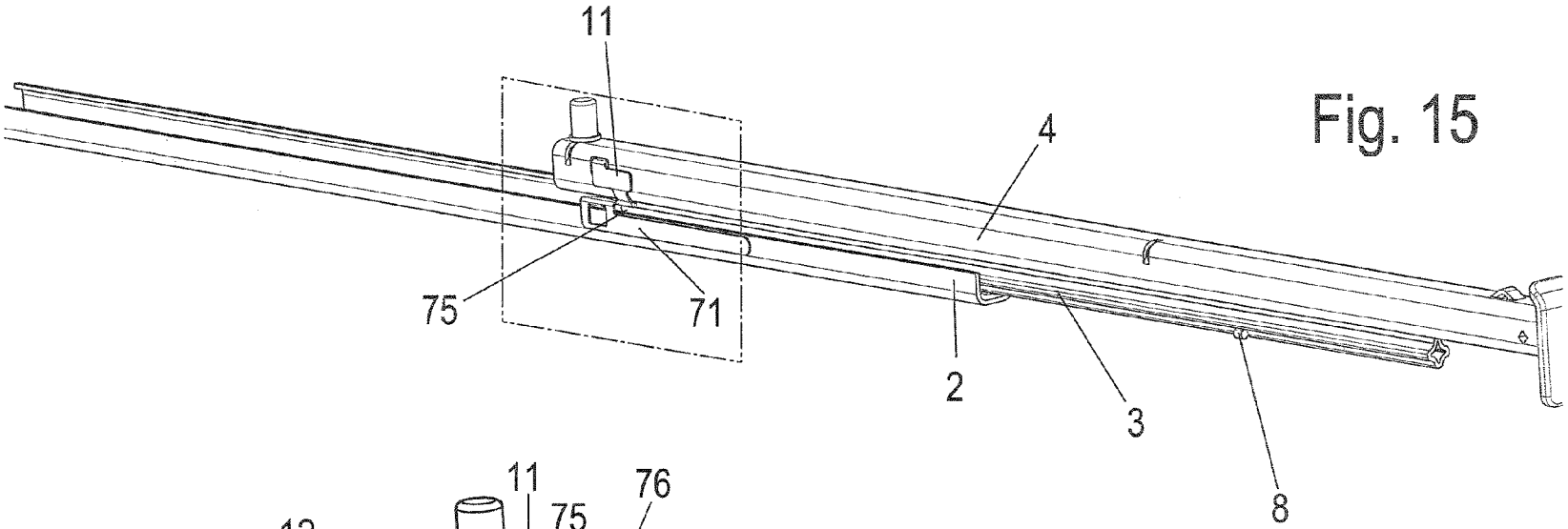
FIG. 15 highlights the unlocking of the locking mechanism by movement of the third rail.
Figure 16:
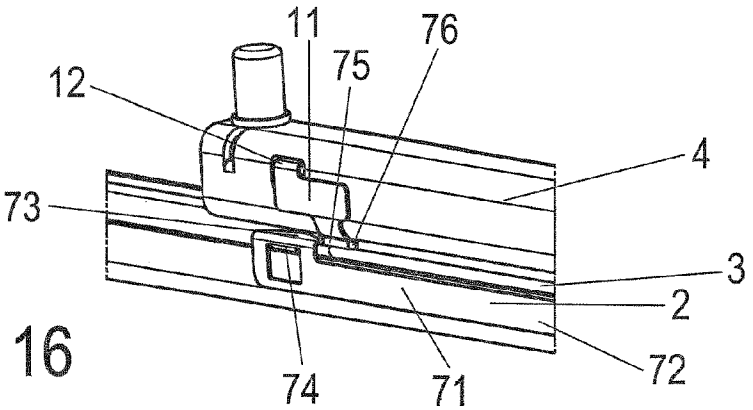
FIG. 16 shows the locking mechanism in great detail, to highlight the unlocking.

To unlock the locking mechanism 70, the third rail 4 is moved in the closing direction, until the position shown in FIGS. 15 and 16 is reached. In this position, the unlocking element 75 engages with the intake bevels 76 on the actuating section 73, which is thus pressed outward during a movement of the third rail 4 in the closing direction, so that the projection 74 disengages from the embossed area 77 on the second rail 3. The blockade of the second rail 3 in the closing direction is thus canceled and the second rail 3 can now be moved in the closing direction, wherein the actuating section 73 enables a movement of the projection 74 inward after passing over the second intake bevel 76, wherein the embossed area 77 is then already arranged on the opposite side of the projection 74.

Figure 17:
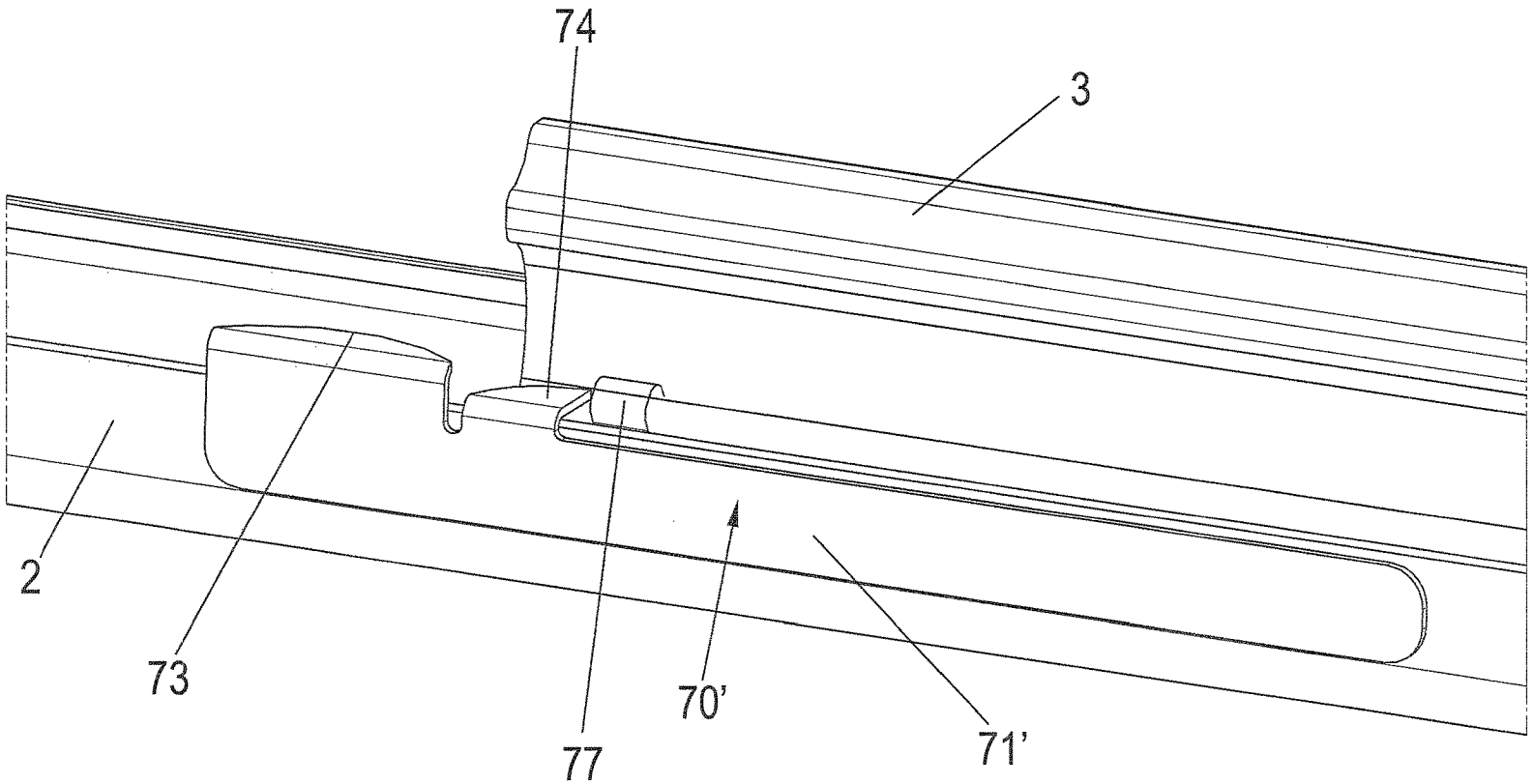
FIG. 17 shows a fourth exemplary embodiment of a pullout guide according to the invention.
Figure 18:
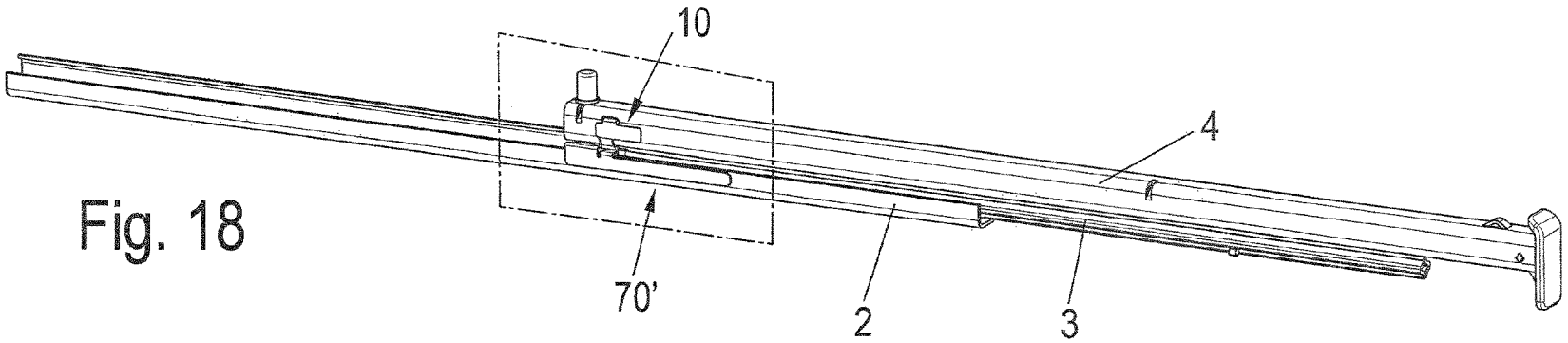
FIG. 18 shows a locking mechanism that is modified as compared to the locking mechanism depicted in the pull-out guide of FIGS. 12-15.
Figure 19:
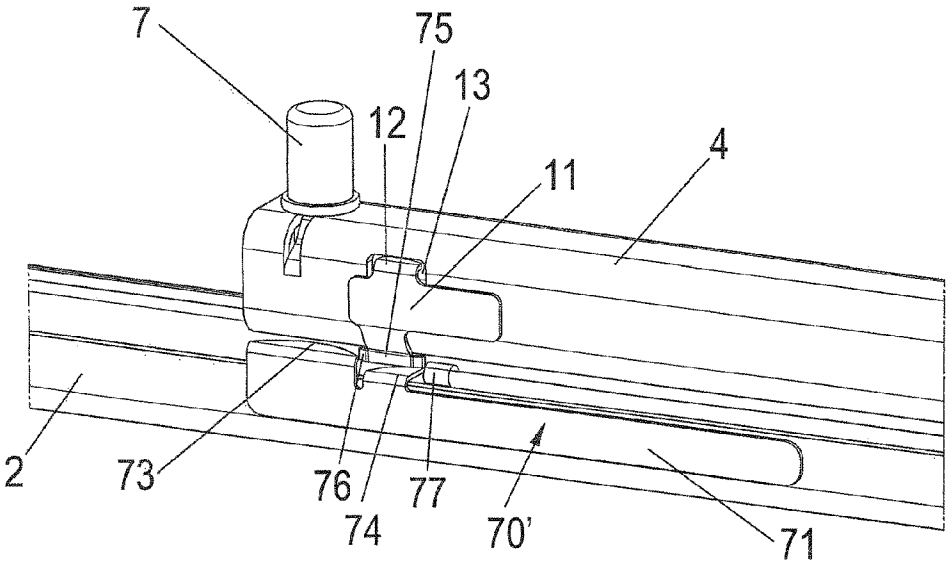
FIG. 19 highlights details of the modified locking mechanism.
Figure 20:
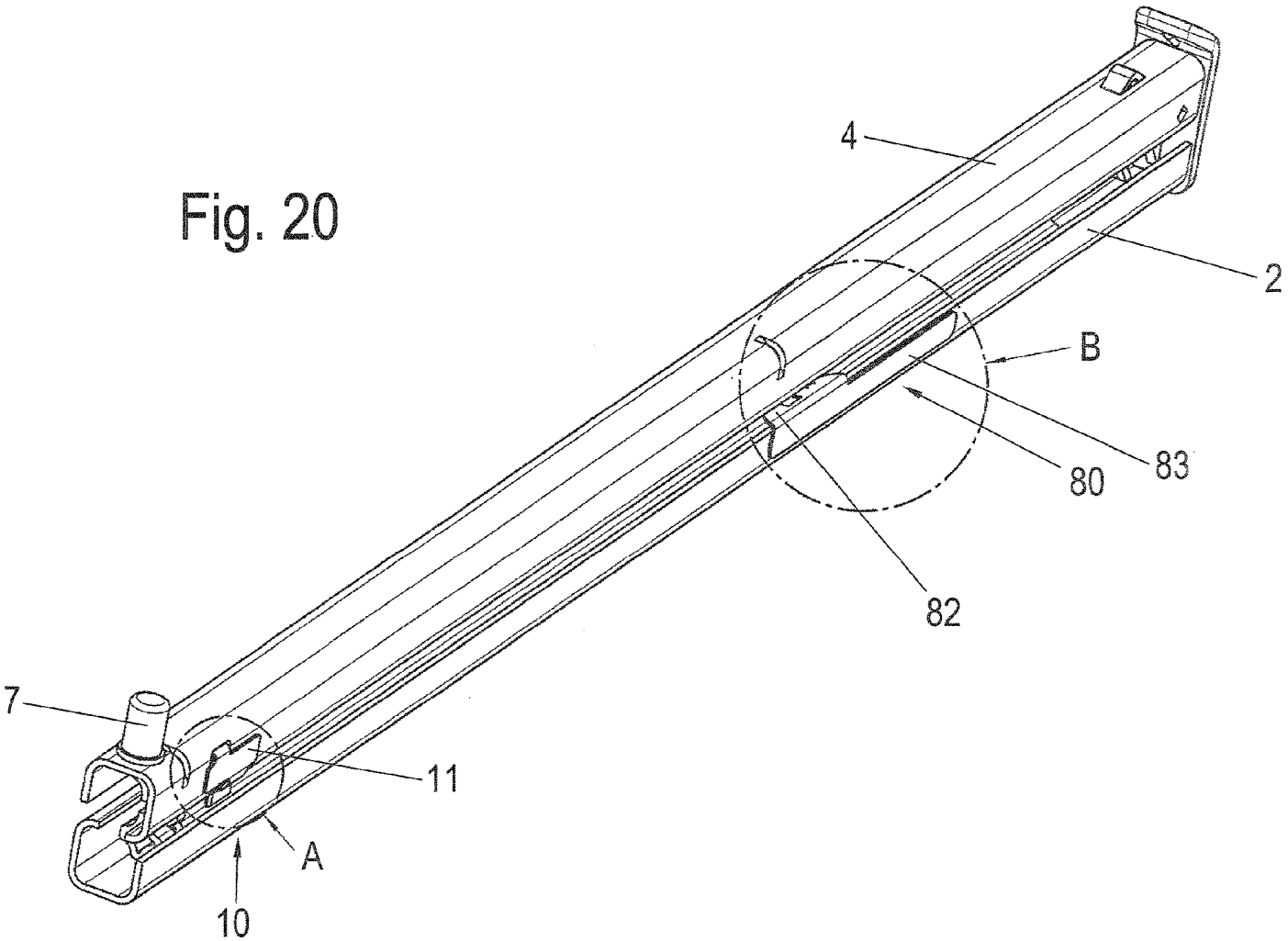
FIG. 20 shows a fifth exemplary embodiment of a pullout guide according to the invention.

FIGS. 17 to 19 show a modified embodiment in which the actuating section 73 and the projection 74 are not arranged one above another, as in FIG. 16, but rather adjacent to one another, wherein a modified locking mechanism 70' is provided, on which a spring web 71 having an integrally implemented projection 74 and an integrally implemented actuating section 73 are provided, which act in the function as in the preceding exemplary embodiments, however. During the movement of the third rail 4 in the closing direction, an unlocking element 75 having intake bevels, which is implemented on the spring web, causes a movement of the actuating section 73 outward, whereby the projection 74 disengages from the embossed area 77 on the second rail 3. The blockade of the middle second rail 3 is thus canceled and the pullout guide can be moved completely into the retracted position.

FIGS. 20 to 26 show a further exemplary embodiment of a pullout guide, in which a catch mechanism 10 is provided on three rails 2, 3, and 4, which is implemented as in FIGS. 1 and 8 and in addition has the bendable spring element 11 and the projection 12, wherein an unlocking element 75 having an intake bevel 76 is additionally provided. A locking mechanism 80 is arranged spaced apart from the catch mechanism 10, which has a bendable spring web 81, which has a fastening section 83 on one end and a projection 82 spaced apart from the fastening section 83. The pullout guide is shown in this case in a retracted position in FIG. 20.

Figure 21:
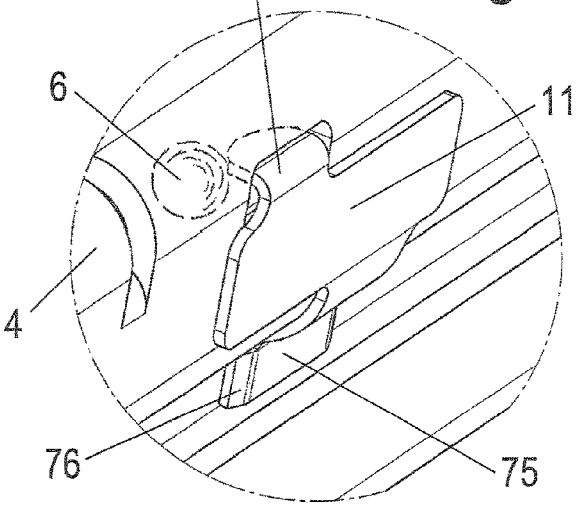
FIG. 21 highlights features of a catch mechanism of the pull-out guide.

As is recognizable from the enlarged detail view of FIG. 21, the catch mechanism engages with the projection 12 behind a roller body 6, which is implemented as a sphere, and therefore latches the rail 4 on the rail 3.

Figure 22:
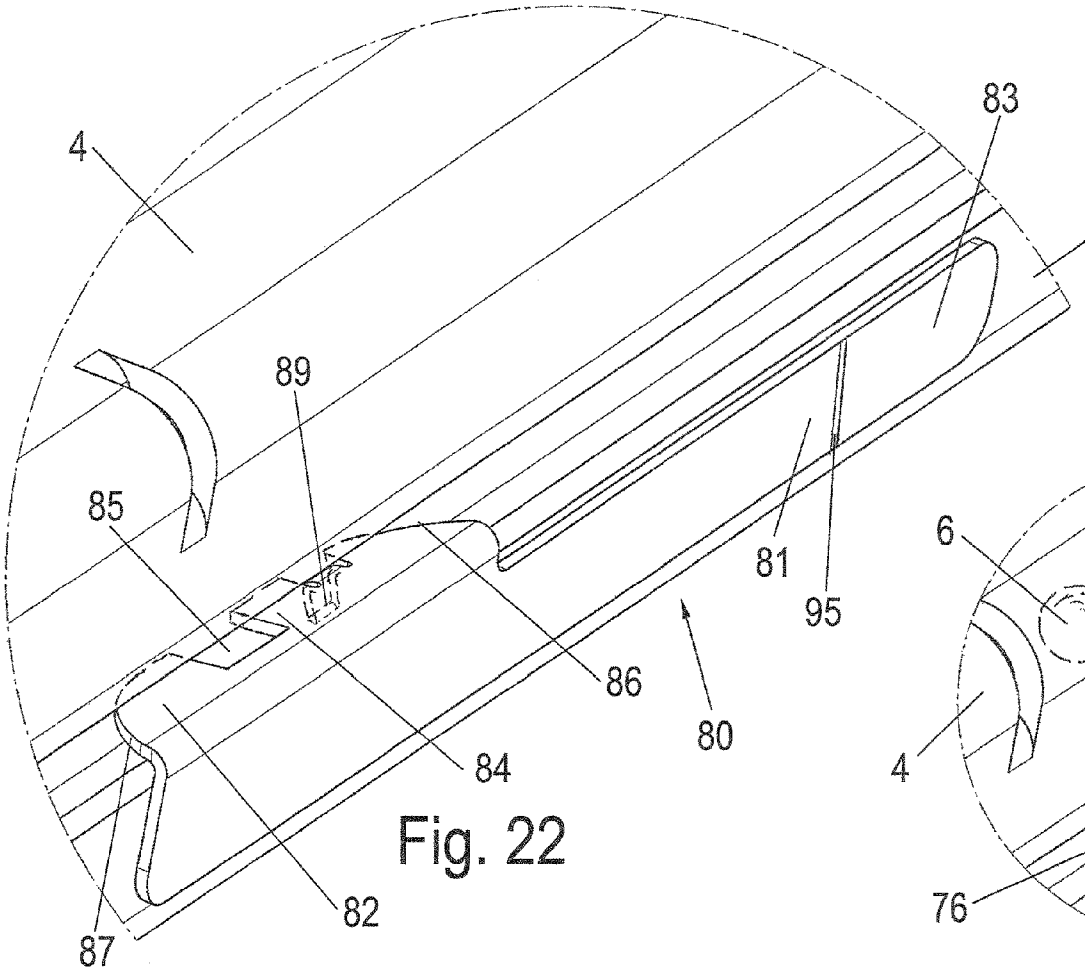
FIG. 22 highlights features of a locking mechanism modified with respect to the locking mechanisms of the first through fourth embodiments of the pull-out guide.

FIG. 22 shows the locking mechanism 80, which is fixed on the rail 2. A projection 82 is implemented on the bendable spring web 81, which protrudes essentially perpendicularly from the strip-shaped spring web 81 and engages between the rails 2 and 4. A recess 85 for receiving an embossed area 77 on the rail 3 is provided on the projection 82, this recess being enclosed by a further projection 84. Furthermore, a stop 89 is erected from the projection 84, which prevents the projection 82 from being deflected by more than a specific amount by the rail 2. For the unlocking operation, the projection 82 is deflected, for example, between 2 mm and 6 mm, so that the stop 89 is used to limit the bending movement, to prevent a plastic deformation of the bendable spring web 81.

As shown in FIG. 22, the fastening section 83 has a narrow folded edge 95 in the direction of the rail 2, which is used for pre-tension, to ensure a secure contact of the spring web 81 and the rear locking spring end after being welded on and therefore prevent undesired bending.

Figure 23:
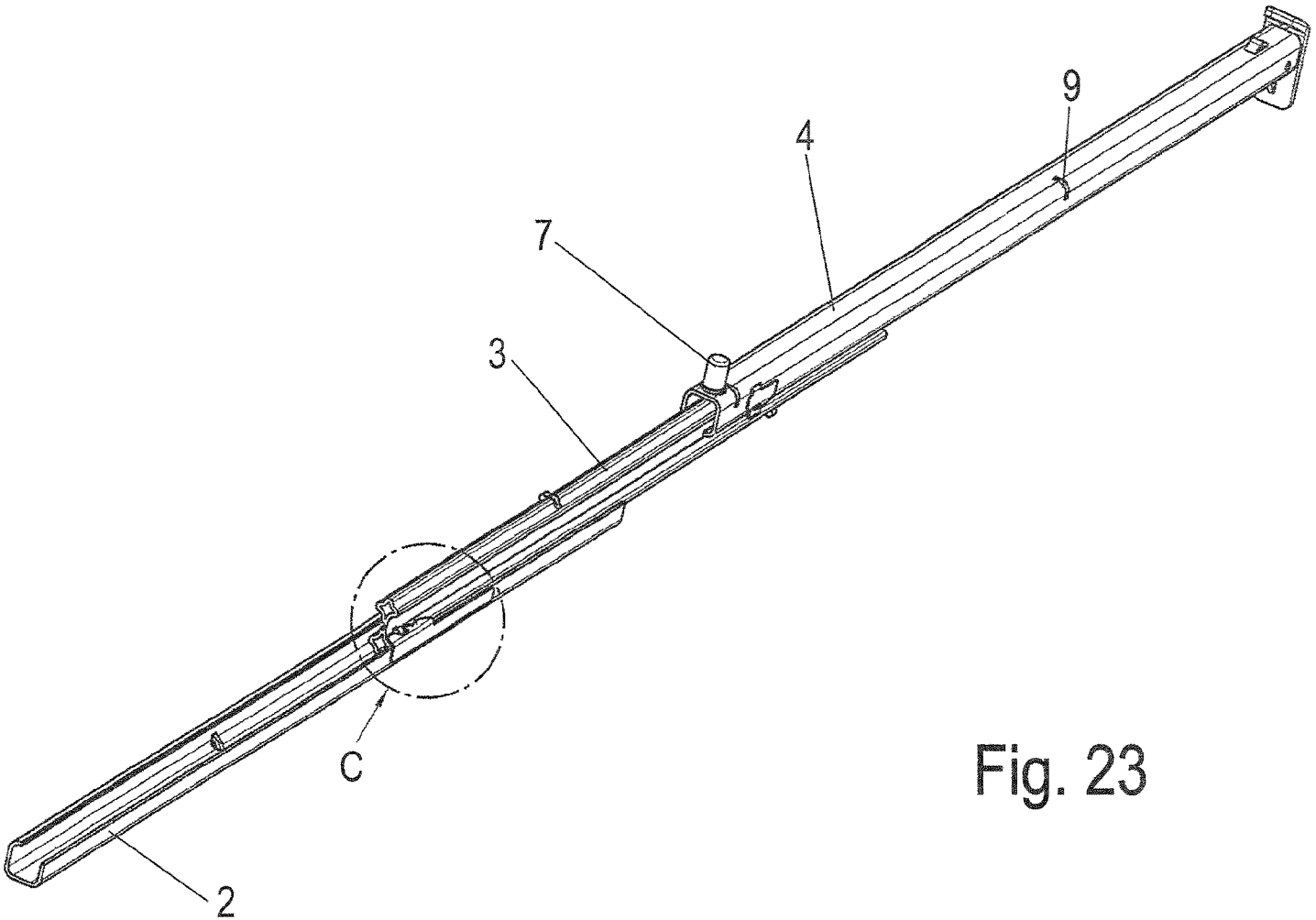
FIG. 23 shows the pull-out guide in a pulled-out position.
Figure 24:
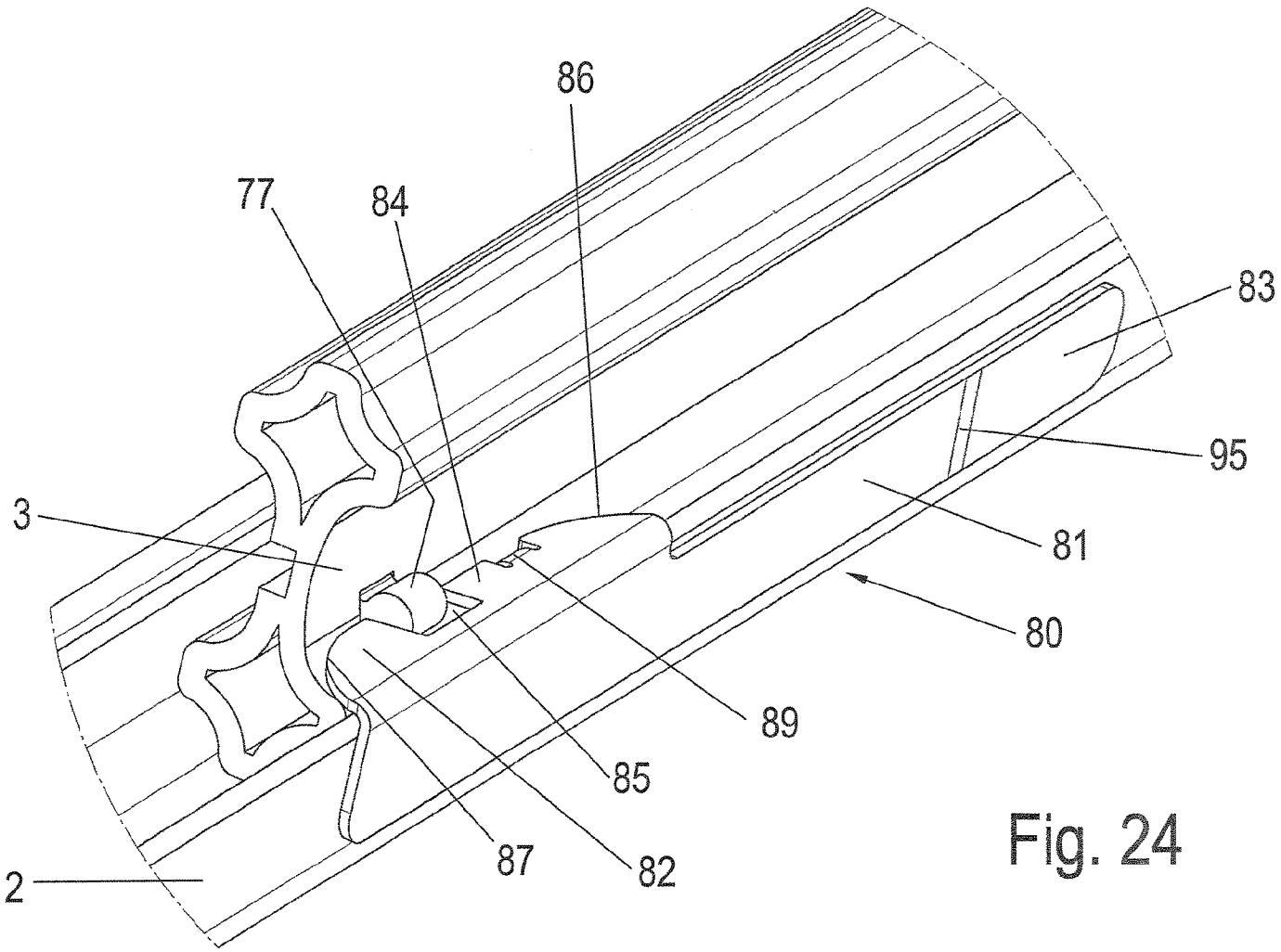
FIG. 24 shows a modified locking mechanism of the FIG. 23 pull-out guide.
Figure 25:
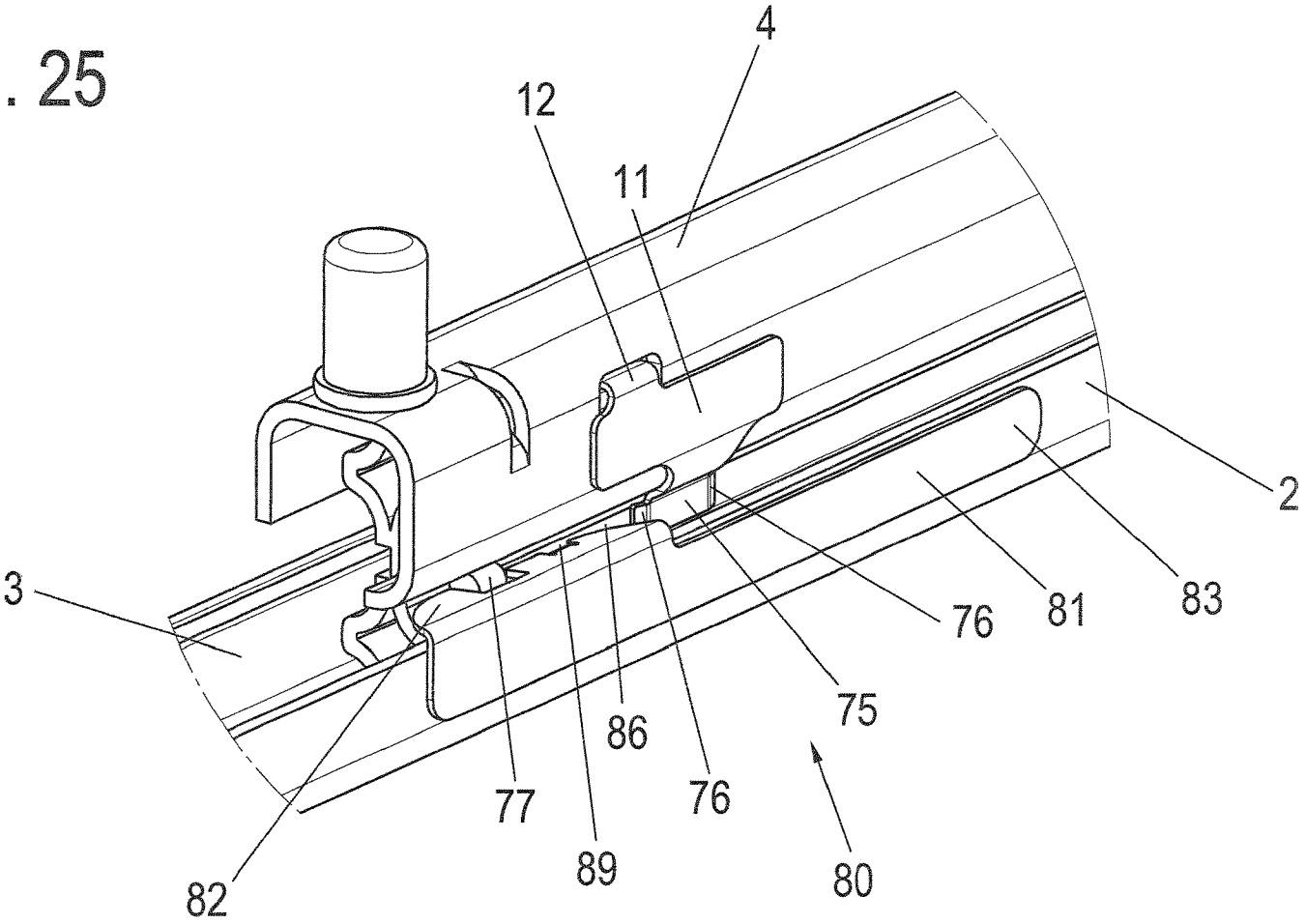
FIG. 25 highlights the locking mechanism in a locked state.

FIGS. 23 to 25 show the pullout guide in a pulled-out position, wherein the locking mechanism 80 is locked. For this purpose, an embossed area 77 on the rail 3 engages in the recess 85 between the projections 82 and 84. The rails 2 and 3 thus cannot be moved in relation to one another, while the rail 4 implemented as a slide rail can be moved into a retracted position after overcoming the latch forces. During a closing movement, the rail 4 then reaches the locking mechanism 80, wherein intake bevels 86 and 87 are implemented on the side opposite to the projections 82 and 84, which come into contact with the intake bevels 76 of the unlocking element 75, so that the projections 82 and 84 are moved outward from the rail 2, at most until the stop 89 limits the movement, and the embossed area 77 moves out of the recess 85, so that the rails 2 and 3 can be moved in relation to one another. The rail 3 can subsequently also be moved in the closing direction.

Figure 26:
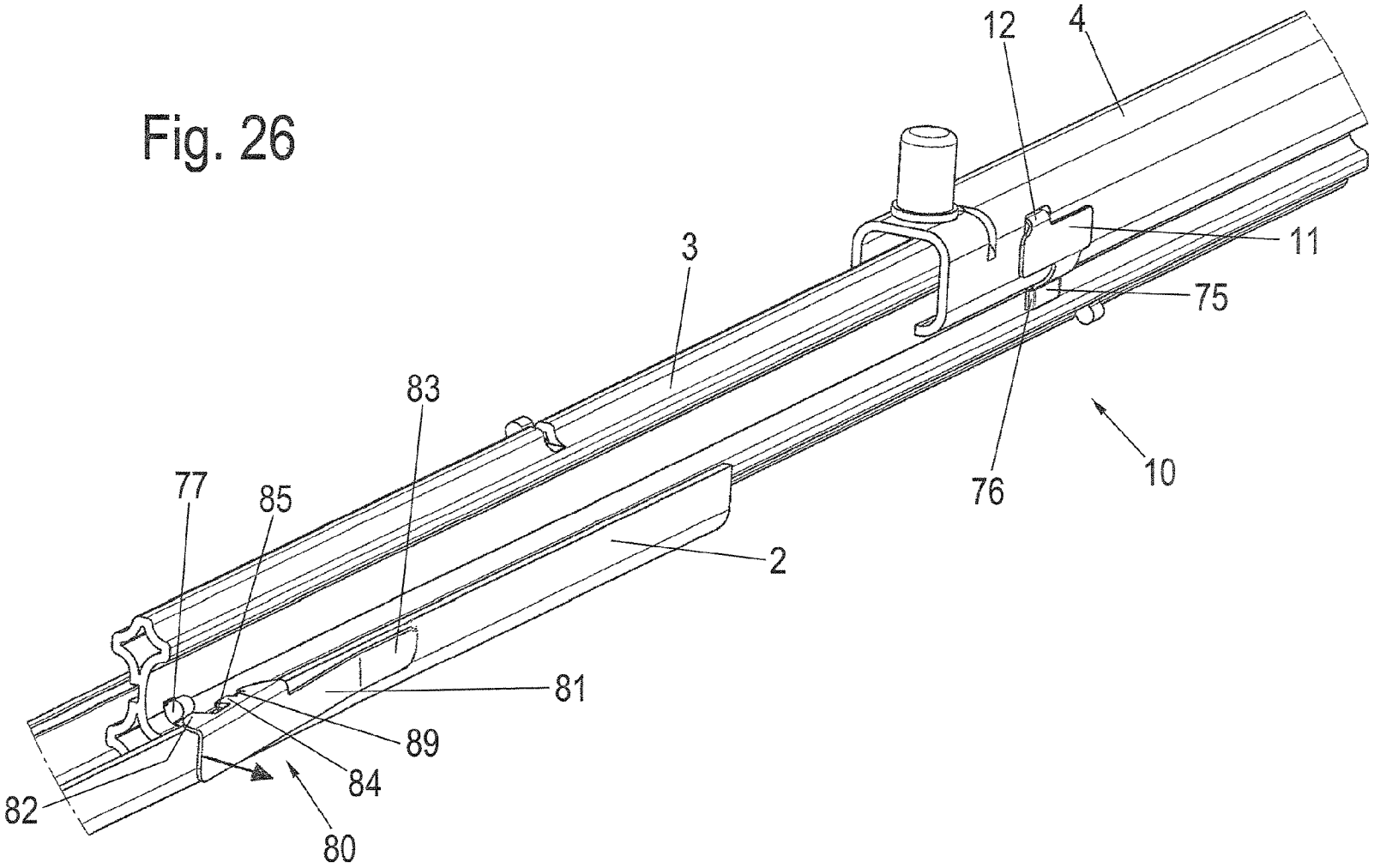
FIG. 26 highlights how the locking mechanism is unlocked from the locked state.

FIG. 26 shows the pullout guide during an extension movement of the rails 3 and 4, wherein the embossed area 77 at the intake bevel 87 of the projection 82 presses against the rail 3, so that corresponding to the illustration of the arrow, the spring web 81 is bent away from the rail 2. The rail 3 can thus be moved further in the extension direction until the embossed area 77 engages in the recess 85 between the projections 82 and 84. The rails 2 and 3 are thus locked in relation to one another. To limit the bending movement outward, a stop 89 is implemented by an angled web on the projection 84, which prevents the spring web 81 being manually moved away from the rail 2 farther than required for the unlocking operation or the latching operation.

In the illustrated exemplary embodiments, a catch mechanism 10 is located in each case between the movable third rail 4 and the middle second rail 3. The locking mechanism is arranged between the second rail 3 and the first rail 2, which can be fixed on a body. Of course, it is also possible to arrange the catch mechanism 10 between the rail 2, which can be fixed on the body, and the middle second rail 3 and to provide the locking mechanism in each case between the second rail 3 and the movable rail 4.

In addition, in the illustrated exemplary embodiments, a predetermined catch position is provided in the completely extended position of the pullout guide 1, 1', 1". Of course, it is also possible to provide the predetermined catch position at another position and/or to arrange multiple catch positions on the movement path of the pullout guide.

The pullout guides 1, 1', 1" can be produced completely from metallic components, since both the catch mechanism and also the locking mechanism are preferably produced from stamped and bent metal plates. The pullout guides 1, 1', 1" can thus preferably be used for domestic appliances, such as ovens, in particular they have a high temperature resistance. Usage for other fields, such as furniture, refrigerators, or other intended uses, is also possible.

LIST OF REFERENCE NUMERALS

1, 1', 1" pullout guide
2 first rail
3 second rail
4 third rail
5 roller body cage
6 roller body
7 plug
8 embossed area
9 profile
10 catch mechanism
11 spring element
12 projection
13 opening
14 end section
15 plate
19 profile
31 cross-shaped section
32 cross-shaped section
40 locking mechanism
41 spring web
42 projection
43 fastening section
44 recess
45 unlocking element
46 intake bevel
48 actuating section
50 locking mechanism
51 spring element
52 projection
53 opening
54 section
55 end
58 actuating section
60 pocket
70, 70' locking mechanism
71 spring web
72 end section
73 actuating section
74 projection
75 unlocking element
76 intake bevel
77 embossed area
80 locking mechanism
81 spring web
82 projection
83 fastening section
84 projection
85 recess
86 intake bevel
87 intake bevel
88 bend
89 stop
95 folded edge

What is claimed is:

1. A pullout guide for domestic appliances or furniture, having a first rail, a second rail and a third rail mounted to be movable in relation to one another, wherein the first rail is fixed on a body and the third rail is connected to a thrust element, wherein a locking mechanism is provided to lock the second rail against movement in relation to the first rail in a predetermined locking position, wherein the locking mechanism comprises a locking element, which is pre-tensioned so as to be biased in the predetermined locking position, wherein the locking mechanism further comprises a catch mechanism embodying spring web with a fastening section, wherein a folded edge is provided adjacent the fastening section to pre-tension the spring web against one of the first, the second and the third rail, and wherein the catch mechanism has a spring element, which is bent before reaching the predetermined position of the second and the third rails, to then engage behind a catch means.

2. The pullout guide according to claim 1, wherein the locking element is fixed on one of the first, the second and the third rails of the pullout guide.

3. The pullout guide according to claim 1, wherein an unlocking element is provided, to unlock the locking mechanism and enable a movement of the second rail in relation to the first rail.

4. The pullout guide according to claim 3, wherein the unlocking element for the locking mechanism is provided on the third rail.

5. The pullout guide according to claim 4, wherein the unlocking element is movable together with the third rail and the locking element is movable via the unlocking element substantially perpendicularly to a longitudinal direction of the rails.

6. The pullout guide according to claim 1, wherein the locking element is produced from a bent metal plate.

7. The pullout guide according to claim 1, wherein an unlocking element engages on a roller body cage or a roller body between the first or second rail.

8. The pullout guide according to claim 1, wherein locking element is implemented integrally with a bendable lever, which has an actuating section on which the unlocking element can engage.

9. The pullout guide according to claim 1, wherein the locking element is implemented as a projection on a bendable lever, which engages through a recess on one of the first, the second and the third rail and implements a stop for a roller body cage, a roller body, or a wall section of one of the first, the second and the third rail.

10. The pullout guide according to claim 1, wherein a stop is provided to limit a movement of a locking element on a spring web.

11. The pullout guide according to claim 1, wherein the locking mechanism comprises a catch mechanism and wherein the catch mechanism is provided, to latch the third rail in a predetermined position in relation to the second rail.

12. The pullout guide according to claim 1, wherein the catch means is a roller body or a projection on a roller body cage.

13. The pullout guide according to claim 12, wherein the spring element of the catch mechanism comprises a projection, on which intake bevels are implemented, which can be contacted by the roller body, the projection on the roller body cage or both.

14. A pullout guide for domestic appliances or furniture, having a first rail, a second rail and a third rail mounted to be movable in relation to one another, wherein the first rail is fixed on a body and the third rail is connected to a thrust element, wherein a locking mechanism is provided to lock the second rail against movement in relation to the third rail in a predetermined locking position, wherein the locking mechanism comprises a locking element, which is pre-tensioned so as to be biased in the predetermined locking position, wherein the locking mechanism further comprises a catch mechanism embodying a spring web with a fastening section, wherein a folded edge is provided adjacent the fastening section to pre-tension the spring web against one of the first, the second and the third rail, and wherein the catch mechanism has a spring element, which is bent before reaching the predetermined position of the second and the third rails, to then engage behind a catch means.

15. A pullout guide for domestic appliances or furniture, having a first rail, a second rail and a third rail mounted to be movable in relation to one another, wherein the first rail is fixed on a body and the third rail is connected to a thrust element, wherein a locking mechanism is provided to lock the second rail against movement in relation to the first rail in a first predetermined locking position, wherein the locking mechanism comprises a locking element, which is pre-tensioned so as to be biased in the first predetermined locking position, wherein the locking mechanism comprises a catch mechanism to latch the third rail in a second predetermined position in relation to the second rail, wherein the catch mechanism comprises a bendable spring element with an unlocking element to unlock the locking mechanism, and wherein the unlocking element is formed as a projection from the spring element.

16. A pullout guide for domestic appliances or furniture, having a first rail, a second rail and a third rail mounted to be movable in relation to one another, wherein the first rail is fixed on a body and the third rail is connected to a thrust element, wherein a locking mechanism is provided to lock the second rail against movement in relation to the first rail in a predetermined locking position, wherein the locking mechanism comprises a bendable spring web with a fastening section on one end, and on another end, the spring web includes a locking element comprising a first projection, a second projection and a stop, wherein the locking element is pre-tensioned so as to be biased in the predetermined locking position, and wherein the stop prevents the first projection from being deflected by more than a specific amount by the second rail.

* * * * *